US008863707B2

(12) United States Patent
Weiβer

(10) Patent No.: US 8,863,707 B2
(45) Date of Patent: Oct. 21, 2014

(54) CAMSHAFT ADJUSTER

(75) Inventor: Sven Weiβer, Weisendorf (DE)

(73) Assignee: Schaeffler Technologies GmbH & Co. KG, Herzogenauach (DE)

( * ) Notice: Subject to any disclaimer, the term of this patent is extended or adjusted under 35 U.S.C. 154(b) by 86 days.

(21) Appl. No.: 13/596,512

(22) Filed: Aug. 28, 2012

(65) Prior Publication Data

US 2013/0055978 A1 Mar. 7, 2013

(30) Foreign Application Priority Data

Sep. 1, 2011 (DE) ..... 10 2011 081 971

(51) Int. Cl.
*F01L 1/34* (2006.01)
*F01L 1/344* (2006.01)

(52) U.S. Cl.
CPC ..... *F01L 1/3442* (2013.01)
USPC ..... 123/90.15; 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 2009/0188456 | A1 * | 7/2009 | Dupuis et al. | 123/90.17 |
| 2010/0089352 | A1 * | 4/2010 | Myers et al. | 123/90.17 |
| 2010/0199937 | A1 | 8/2010 | Fujiyoshi | |
| 2011/0030632 | A1 * | 2/2011 | David et al. | 123/90.17 |
| 2012/0085304 | A1 * | 4/2012 | Heintzen et al. | 123/90.17 |
| 2012/0318222 | A1 * | 12/2012 | Weber | 123/90.15 |
| 2013/0180482 | A1 * | 7/2013 | Weber | 123/90.15 |

FOREIGN PATENT DOCUMENTS

| | | |
|---|---|---|
| DE | 102006002993 | 8/2007 |
| DE | 102007039282 | 2/2009 |
| DE | 102008051732 | 4/2010 |
| DE | 102008051755 | 4/2010 |
| DE | 102010009394 | 9/2011 |
| WO | WO 2011104055 A1 * | 9/2011 |

* cited by examiner

*Primary Examiner* — Thomas Denion
*Assistant Examiner* — Steven D Shipe
(74) *Attorney, Agent, or Firm* — Volpe and Koenig, P.C.

(57) ABSTRACT

A camshaft adjuster (1) that has a spring (4) covered at least partially by a spring cover (5) is provided, with the spring cover (5) having spacer elements (6) that fix the spring ends (7) in the axial direction such that the spring windings of the spring (4) have, as much as possible, no axial contact with the peripheral components.

7 Claims, 3 Drawing Sheets

CAMSHAFT ADJUSTER

CROSS-REFERENCE TO RELATED APPLICATIONS

This application claims the benefit of German Patent Application No. 102011081971.1, filed Sep. 1, 2011, which is incorporated herein by reference as if fully set forth.

FIELD OF THE INVENTION

The invention relates to a camshaft adjuster.

BACKGROUND OF THE INVENTION

Camshaft adjusters are used in internal combustion engine for varying the control times of the combustion chamber valves, in order to be able to vary the phase relation between the crankshaft and camshaft in a defined angular range between a maximum advanced position and a maximum retarded position. Adapting the control times to the current load and rotational speed reduces consumption and emissions. For this purpose, camshaft adjusters are integrated in a drive train by which a torque is transferred from the crankshaft to the camshaft. This drive train can be realized, for example, as a belt, chain, or gearwheel drive.

In a hydraulic camshaft adjuster, the driven element and the drive element form one or more pairs of pressure chambers that act against each other and can be pressurized with oil pressure. The drive element and driven element are here arranged coaxial to each other. By filling and emptying individual pressure chambers, a relative movement between the drive element and driven element is generated. The spring causing rotation between the drive element and the driven element forces the drive element in a preferred direction against the driven element. This preferred direction can be in the same direction or opposite the direction of rotation.

One common construction of a hydraulic camshaft adjuster is the vane cell adjuster. Vane cell adjusters have a stator, a rotor, and a drive element. The rotor is usually locked in rotation with the camshaft and forms the driven element. The stator and the drive element are likewise locked in rotation with each other and are optionally also constructed in one piece. Here, the rotor is located coaxial to the stator and within the stator. With their vanes extending in the radial direction, the rotor and stator form oil chambers that act in opposite directions and can be pressurized by oil pressure and allow a relative movement between the stator and rotor. Furthermore, the vane cell adjusters have various sealing covers. The stator, drive element, and sealing covers are secured by several screw connections.

Another known construction of hydraulic camshaft adjusters is the axial piston adjuster. Here, a displacement element is displaced in the axial direction by oil pressure, wherein this displacement element generates a relative rotation between a drive element and a driven element via helical gearing.

Another construction of a camshaft is the electromechanical camshaft adjuster that has a triple-shaft gearing (for example, a planetary gear). Here, one of the shafts forms the drive element and a second shaft forms the driven element. Through the use of the third shaft, rotational energy can be fed to the system by an adjustment device, for example, an electric motor or a brake, or can be discharged from the system. Here, a spring can likewise be arranged such that the drive element and the driven element are supported or restored in a relative rotation.

DE 10 2006 002 993 A1 discloses a camshaft adjuster in which the spring element is arranged on the side of the camshaft adjuster facing the camshaft. The spring element is covered by a spring cover. The cover secures the spring element in the axial direction and protects against external effects.

DE 10 2008 051 755 A1 discloses a camshaft adjuster with a spring element, wherein one end of the spring element is supported on a pin that is screwed with a washer. A pot-shaped spring cover encapsulates the spring element with this washer and protects against external effects.

SUMMARY

The object of the invention is to provide a camshaft adjuster that has a low-friction and reliable spring clip.

This objective is met by a camshaft adjuster with one or more features of the invention.

The axial play of the spring is reduced by a spacer element of the spring cover in the area of a spring end of the spring. At the same time, enough axial play remains for the windings of the spring that have a deviation from its ideal extent in the radial direction during operation of the camshaft adjuster and due to manufacturing tolerances. Thus, a collision of the windings of the spring with a peripheral component is avoided, wherein the service life of the spring is increased and the friction during operation is reduced. Furthermore, the invention produces the advantage that manufacturing tolerances with respect to the direction of radial extent of the windings can be greater and thus more economical. This advantage of rough tolerances can also be achieved in the peripheral components, e.g., in the spring cover.

In one construction of the invention, the spacer element is constructed as a local raised section in one piece with the spring cover. Such a raised section can be produced by embossing, deep-drawing, or milling. A local production is advantageous, so that the areas of the spring that are subject to minimal relative movement between the spring and a peripheral component during operation are secured by the spring cover in the axial direction. Therefore, friction and wear are minimized and the service life of the spring is increased.

In an optional construction of the invention, the spacer element is constructed separately from the spring cover. The component separation between the spring cover and the spacer element as an insert part advantageously allows the selective use of materials for certain functions. For example, the spring cover could be made from a material that withstands certain environmental effects and the spacer element could be made from a wear-resistant and/or higher-quality material.

In one advantageous construction, the spring cover is connected to the spacer element with a material-fit, positive-fit, and/or non-positive-fit connection. Preferably, a material-fit connection is provided, alternatively also in combination with a positive-fit or non-positive-fit connection, wherein the spacer element is embedded, bonded, welded, or soldered into the spring cover. Positive-fit and non-positive-fit connections equally position the spacer reliably with the spring cover on the functional position provided for this purpose on the axial contact of the spring end with the spacer element.

In one especially preferred construction, the spring cover is made from sheet metal or from plastic. Due to the low weight and the nevertheless high stiffness, the construction of a spring cover made from sheet metal in a thin-walled pot shape is preferred. A construction of the spring cover made from plastic is to be preferred when this is cost effective relative to sheet metal and high temperatures are not expected during operation at the position of the spring cover or the temperature resistance of the plastic is adequate.

In one preferred construction, the spacer element has a coating. The coating reduces the wear and the weight in the construction of the spacer element as a base carrier with an economical material, e.g., plastic.

In one construction of the invention, multiple spacer elements distributed in the peripheral direction are provided. A distribution of several spacer elements is advantageous when the loading of an individual spacer element is too high and it could lead to failure. The distribution in the peripheral direction is preferably arranged outside of the spring windings. Spacer elements distributed in the peripheral direction can be arranged on different pitch circles and/or at different angular positions.

In one advantageous construction, the spacer element is arranged in the area of the support for the spring end. Fixing the spring ends in the axial direction on the support avoids displacement in the axial direction in the area of the spring windings.

In one especially advantageous construction, the spacer element projects around the support. This projection can be partial or complete. The support is usually given by a pin or a different cylindrical element. Thus, the projection could also have a star-shaped construction with the support as the center. The projection has, however, an open position in the form of the cross section of the support, so that longer support pins can project partially into the spring cover. The support pin projecting through the spring cover is conceivable.

Through the arrangement of the spacer element according to the invention, the friction between the spring and the spring cover or other peripheral components is avoided. In this way, the wear is reduced and the service life is increased. In addition, the spring windings of the spring during operation have sufficient axial space, in order to avoid contact with the peripheral components. The contact surface of the spring ends of the spring on the support remains the same or can be advantageously increased by the invention.

BRIEF DESCRIPTION OF THE DRAWINGS

Embodiments of the invention are shown in the figures.

Shown are.

DETAILED DESCRIPTION OF THE PREFERRED EMBODIMENTS

Figure 1:
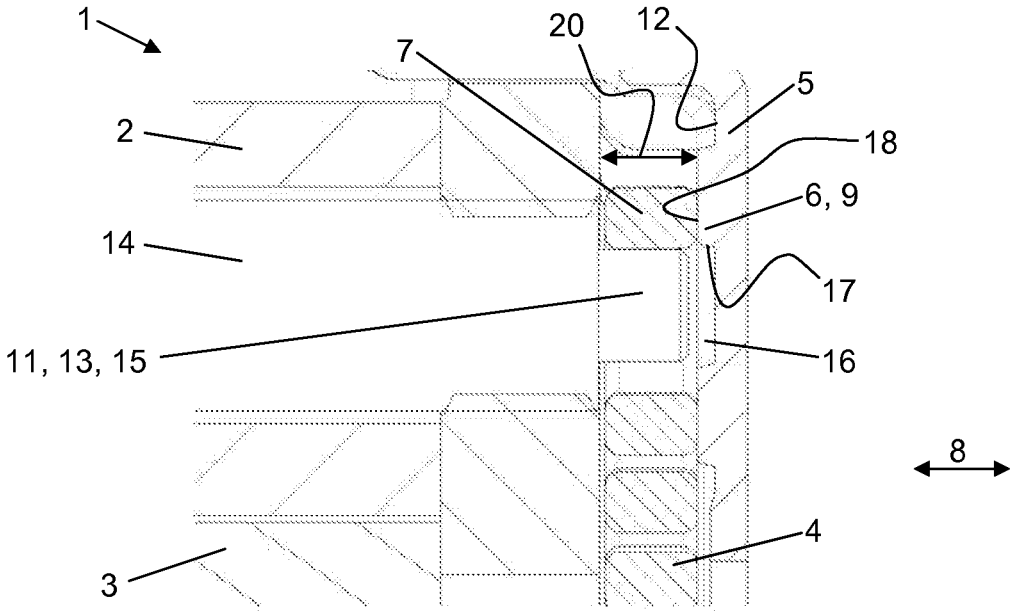
FIG. 1 is a section of a camshaft adjuster.

FIG. 1 shows a section of a camshaft adjuster 1. The camshaft adjuster 1 has a drive element 2, a driven element 3, a spring 4, and a spring cover 5. The drive element 2 and the driven element 3 are arranged so that they can rotate relative to each other. The relative rotation in the peripheral direction 10 of the camshaft adjuster 1 can be realized, e.g., by filling pressure chambers with hydraulic medium, wherein the pressure chambers are formed between the drive element 2 and the driven element 3. The spring 4 tensions the drive element 2 and driven element 3 relative to each other in a peripheral direction 10. The biasing provides relative rotation between the drive element 2 and the driven element 3. So that the spring 4 is protected from external effects, this is at least partially covered or encapsulated by a spring cover 5. During operation, the spring cover 5 further secures the spring 4 in the axial direction 8 and prevents slippage of its spring ends 7 from the support 11. The spring 4 is constructed as a spiral spring whose spring windings extend predominantly perpendicular to the axial direction 8.

The drive element 2 has, integrated or separately, gearing not shown in more detail for a control chain or a belt. The driven element 3 can be locked in rotation with a camshaft not shown in more detail.

The spring cover 5 has a spacer element 6 that is in contact with a spring end 7 of the spring 4. The spacer element 6 is constructed in one piece with the spring cover 5 and extends in the axial direction 8 from the end side 12 of the spring cover 5. The support 11 is constructed as a support pin 13 of a screw 14 of the camshaft adjuster 1. The outer diameter of the lateral surface 15 of the support pin 13 is constant in the axial direction 8. The spacer element 6 has a material recess 16, wherein a lateral surface 17 of the material recess 16 is larger than the diameter of the lateral surface 15 of the support pin 13. The spacer element 6 and its material recess 16 can be constructed in the peripheral direction 10 of the camshaft adjuster 1 partial or complete in the peripheral direction. In the axial direction 8, the lateral surface 15 of the support pin 13 does not overlap with the lateral surface 17 of the material recess 16. The end side 18 of the spacer element 6 is parallel to the end side 12 of the spring cover 5 as much as possible. The end side 18 of the spacer element 6 is in contact with the spring end 7 and thus bounds the axial spring space 20.

Figure 2:
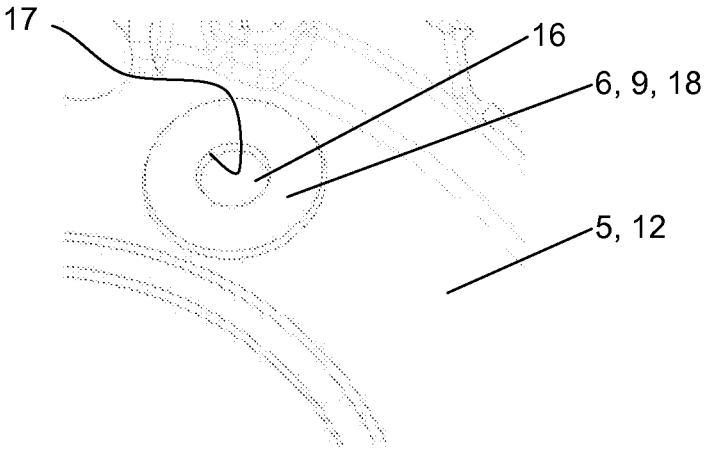
FIG. 2 is a view of a first embodiment of a spacer element.

FIG. 2 shows a first embodiment of a spacer element 6. The spacer element 6 is constructed as a circular disk-shaped, local raised section 9 of the spring cover 5. This local raised section 9 is oriented as flush as possible with the support 11. The local raised section 9 minimizes the contact with the spring end 7 on the area around the support 11.

Figure 3:
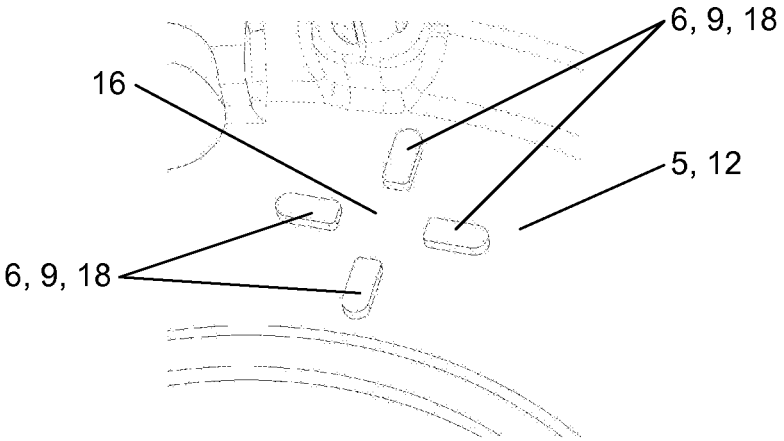
FIG. 3 is a view of a second embodiment of a spacer element.

FIG. 3 shows a second embodiment of a spacer element 6. The spacer element 6 is constructed as a pattern from a plurality of individual raised sections 19. The individual raised sections 19 are arranged in the shape of a star around an imaginary axial projection of the lateral surface 15 of the support pin 13. The distribution of the individual raised sections 19 are spaced as uniform as possible relative to each other.

Figure 4:
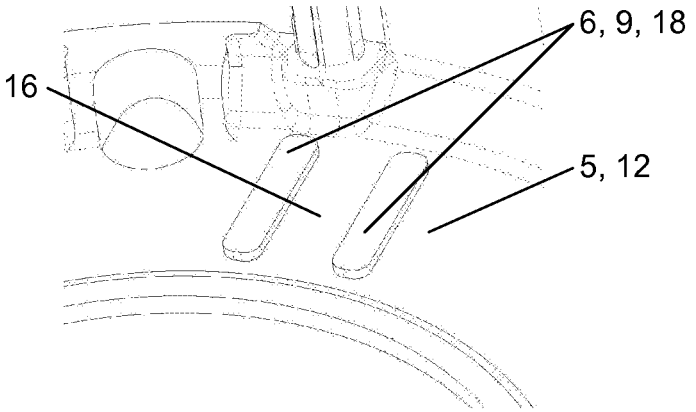
FIG. 4 is a view of a third embodiment of a spacer element.

FIG. 4 shows a third embodiment of a spacer element 6. The spacer element 6 is constructed as a pattern made from a plurality of individual raised sections 19. The individual raised sections 19 are oriented in the same direction relative to each other. The spacing between the individual raised sections 19 leaves open space for an imaginary projection of the lateral surface 15 of the support pin 13.

Figure 5:
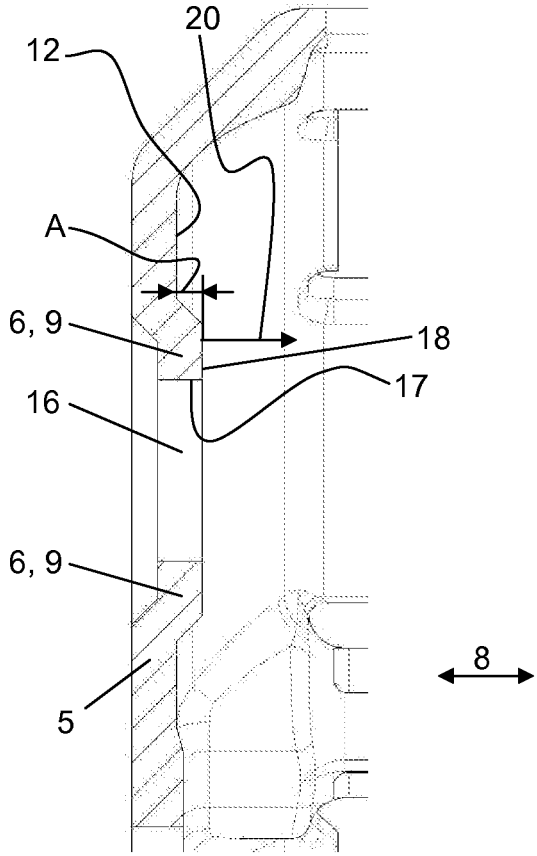
FIG. 5 is a view of a section of a spring cover with a spacer element.

FIG. 5 shows a section of a spring cover 5 with a spacer element 6. The spacer element 6 is constructed in one piece from the spring cover 5. The spring cover 5 and the spacer element 6 have essentially the same wall thickness. The spacer element 6 has a material recess 16 with a lateral surface 17 that extends across the entire wall thickness. This open space can be penetrated by a support 11. An offset A of the spacer element 6 from the spring cover 5 in the axial direction 8 bounds the axial spring space 20.

LIST OF REFERENCE SYMBOLS

1 Camshaft adjuster
2 Drive element
3 Driven element
4 Spring

5 Spring cover
6 Spacer element
7 Spring end
8 Axial direction
9 Raised section
10 Peripheral direction
11 Support
12 End side
13 Support pin
14 Screw
15 Lateral surface
16 Material recess
17 Lateral surface
18 End side
19 Individual raised sections
20 Axial spring space
A Offset

The invention claimed is:

1. A camshaft adjuster comprising:

a drive element, a driven element, a spring, and a spring cover, the drive element and the driven element are arranged so that they can rotate relative to each other, the spring tensions the drive element and the driven element in a peripheral direction, the spring cover is connected to the drive element or the driven element, and the spring cover covers the spring in an axial direction, the spring cover has an inner surface, a spacer element comprises at least one projection extending axially from the inner surface and defines at least partially an outer periphery of a recess on the inner surface in a region of an end of a threaded fastener, the threaded fastener forming a radial contact surface of the spring, and the spacer element limits a degree of freedom of the spring in the axial direction in which the spacer element can be brought into contact with a spring end of the spring.

2. The camshaft adjuster according to claim 1, wherein the spacer element is constructed as a local raised section in one piece with the spring cover.

3. The camshaft adjuster according to claim 1, wherein the spring cover is connected to the spacer element with at least one of a material-fit, positive-fit, or non-positive-fit connection.

4. The camshaft adjuster according to claim 1, wherein the spring cover is constructed from sheet metal or from plastic.

5. The camshaft adjuster according to claim 1, wherein the spacer element has a coating.

6. The camshaft adjuster according to claim 1, wherein several spacer elements are provided that are distributed in a peripheral direction of the spring cover.

7. The camshaft adjuster according to claim 1, wherein the spacer element is arranged in an area of a support of the spring end.

* * * * *